US005361631A

United States Patent [19]

Covington et al.

[11] Patent Number: 5,361,631

[45] Date of Patent: Nov. 8, 1994

[54] APPARATUS AND METHODS FOR DETERMINING THE SHEAR STRESS REQUIRED FOR REMOVING DRILLING FLUID DEPOSITS

[75] Inventors: Rick L. Covington; Kris M. Ravi; Shawn A. Heath; Bryan Waugh, all of Duncan, Okla.

[73] Assignee: Halliburton Company, Duncan, Okla.

[21] Appl. No.: 113,867

[22] Filed: Aug. 27, 1993

Related U.S. Application Data

[63] Continuation-in-part of Ser. No. 65,295, May 21, 1993, Pat. No. 5,309,761, which is a continuation of Ser. No. 939,235, Sep. 2, 1992, abandoned.

[51] Int. Cl.[5] ..... E21B 49/00

[52] U.S. Cl. ..... 73/151; 73/53.01; 73/61.62; 73/865.6

[58] Field of Search ..... 73/53.01, 53.05, 53.06, 73/61.41, 61.62, 61.71, 61.78, 151, 865.6

[56] References Cited

U.S. PATENT DOCUMENTS 4,807,469 2/1989 Hall ..... 73/155
5,309,761 5/1994 Ravi et al. ..... 73/151

OTHER PUBLICATIONS

Paper entitled "Erodability of Partially Dehydrated Gelled Drilling Fluid and Filter Cake" by K. M. Ravi, M. R. Beirute and R. L. Covington, SPE 24571, presentd at the 67th Annual Technical Conference and Exhibition of the Society of Petroleum Engineers held in Washington, D.C., Oct. 4–7, 1992.

*Primary Examiner*—Hezron E. Williams
*Assistant Examiner*—Michael J. Brock
*Attorney, Agent, or Firm*—Robert A. Kent

[57] ABSTRACT

Improved apparatus and methods for determining the shear stress required for removing drilling fluid deposits formed on the walls of a well bore are provided. The methods basically comprise introducing a drilling fluid into a test apparatus which simulates a permeable section of a well bore. Drilling fluid deposits are caused to be formed on the walls of the permeable section, and the drilling fluid is circulated through the permeable section at progressively increasing flow rates for time periods whereby the pressure drop of the drilling fluid stabilizes. The stabilized pressure drop below which no appreciable erosion of the deposits takes place is determined by acoustically measuring and comparing the thicknesses of the drilling fluid deposits at each of the flow rates when the pressure drop stabilized. The minimum shear stress required to erode the deposits is determined from the pressure drop below which no appreciable erosion of the drilling fluid deposits takes place and the erodability of the drilling fluid which is inversely proportionate to the minimum shear stress can also be determined.

22 Claims, 5 Drawing Sheets

APPARATUS AND METHODS FOR DETERMINING THE SHEAR STRESS REQUIRED FOR REMOVING DRILLING FLUID DEPOSITS

This application is a continuation-in-part of application Ser. No. 08/065,295 filed May 21, 1993 now U.S. Pat. No. 5,309,761, which is a continuation of application Ser. No. 07/939,235 filed Sep. 2, 1992, now abandoned.

BACKGROUND OF THE INVENTION

1. Field of the Invention

The present invention relates to apparatus and methods for determining the shear stress required for removing drilling fluid deposits from the walls of well bores.

2. Description of the Prior Art

In the drilling of an oil and/or gas well, a rotary drill bit connected to a string of drill pipe is most commonly used. The drill pipe and drill bit are rotated, and a weighted gelled drilling fluid, e.g., an aqueous clay containing fluid having particulate weighting material suspended therein, is circulated through the well bore to lift cuttings produced by the drill bit to the surface and to maintain hydrostatic pressure in the well bore whereby pressurized fluids contained in penetrated subterranean formations are prevented from entering the well bore. The circulation of the drilling fluid is accomplished by pumping the drilling fluid downwardly through the drill pipe, through ports in the drill bit and then upwardly in the annulus between the drill pipe and the walls of the well bore.

When the drilling of the well bore is completed, the circulation of the drilling fluid is stopped while the drill pipe and drill bit are withdrawn, the well is usually logged and pipe, e.g., casing, is run into the well bore. During this shutdown period, significant quantities of filter cake and partially dehydrated gelled drilling fluid are often deposited on the walls of the well bore as a result of the drilling fluid remaining static in the well bore and the occurrence of fluid loss from the drilling fluid into permeable subterranean formations penetrated by the well bore. The filter cake is principally comprised of particulate weighting material and other solids, and the partially dehydrated gelled drilling fluid is formed from drilling fluid adjacent the walls of the well bore which develops gel strength in the absence of shear and loses a portion of its water as a result of the fluid loss. Also, the remaining drilling fluid in both the pipe and annulus develops gel strength in the absence of shear during the drilling fluid circulation shutdown.

After pipe is run into the well bore, primary cementing operations are performed therein. That is, the pipe is cemented in the well bore by placing a cement slurry in the annulus between the pipe and the walls of the well bore. The cement slurry is intended to set into a hard impermeable mass whereby the pipe is bonded to the walls of the well bore and the annulus is sealed. When the cement slurry is run into the annulus, drilling fluid is displaced from the well bore thereby.

In order for a primary cementing operation to be successful, all of the gelled drilling fluid and at least major portions of the partially dehydrated gelled drilling fluid and filter cake deposited on the walls of the well bore must be removed. If too much of the drilling fluid and filter cake deposits remain on the walls of the well bore, the cement will not properly bond thereto and highly undesirable fluid leakage into and through the well bore will result.

Heretofore, attempts have been made to remove the drilling fluid deposits in the well bore after the above described drilling fluid circulation shutdown period by circulating the drilling fluid through the well bore for a period of time prior to commencing primary cementing. The drilling fluid is continuously pumped downwardly through the pipe to be cemented in the well bore and upwardly through the annulus between the pipe and the walls of the well bore for a period of time during which it has heretofore been hoped that major portions of the partially dehydrated gelled drilling fluid and filter cake are eroded and removed from the walls of the well bore. In attempts to determine if such circulation results in the erosion and removal of the drilling fluid deposits prior to displacing the drilling fluid with a water spacer followed by a cement slurry, marker fluids or materials have heretofore been combined with the circulating drilling fluid at the surface. The time required for the marker to flow through the well bore and reappear on the surface has been determined and such time has been multiplied by the pumping rate of the drilling fluid to estimate the circulating drilling fluid volume. The estimated circulating drilling fluid volume has then been compared with the calculated volume in the well bore available for containing drilling fluid to determine if major portions of the drilling fluid still remain on the walls of the well bore. This technique and other similar techniques for determining the circulating drilling fluid volume have not provided reliable information concerning whether drilling fluid deposits have been removed, and as a result, less than desired primary cementing results have often been obtained.

By the present invention, improved apparatus and methods are provided for measuring the minimum shear stress at the walls of a well bore required to erode drilling fluid deposits formed thereon prior to when the drilling fluid is recirculated after the above-described shutdown period. A knowledge of the minimum shear stress required allows the drilling fluid to be circulated at a proper rate to efficiently remove the drilling fluid deposits, or for special spacer fluid or other means to be employed to bring about such removal prior to placing a primary cementing slurry in the well bore.

SUMMARY OF THE INVENTION

The present invention provides improved apparatus and methods for determining the minimum shear stress required at the walls of a well bore to remove drilling fluid deposits therefrom. The apparatus and methods can also be used for determining an erodability factor for a type of drilling fluid which can subsequently be used to determine the minimum shear stress required to remove deposits formed by that type of drilling fluid. The apparatus basically comprises a container simulating a well bore, means for simulating a permeable subterranean formation disposed within the container, means for circulating a drilling fluid at selected indicated flow rates through the container and across the means simulating a permeable formation therewithin connected to the container, means for measuring the pressure drop of the drilling fluid through the container connected thereto, means for measuring the temperature of the drilling fluid circulating through the container connected thereto, means for withdrawing samples of the drilling fluid whereby its properties can be determined connected to the container, and means for selectively applying pressure to the drilling fluid contained within the container when the drilling fluid is not being circulated connected to the container.

The improved methods of the invention basically comprise the steps of introducing a drilling fluid into a test apparatus which simulates a permeable section of a well bore, maintaining the drilling fluid in a static state in the permeable section at a pressure and for a time period such that drilling fluid deposits are formed therein, circulating the drilling fluid through the permeable section at progressively increasing flow rates and maintaining each of the flow rates for a time period whereby the pressure drop of the drilling fluid through the permeable section stabilizes while measuring the flow rate, the pressure drop, the viscosity, the temperature and the density of the drilling fluid, determining the stabilized pressure drop below which no appreciable erosion of the deposits takes place by acoustically measuring and comparing the thicknesses of the drilling fluid deposits during the circulation of drilling fluid at each of the flow rates when the pressure drop stabilizes and determining the minimum shear stress required to erode the drilling fluid deposits corresponding to the pressure drop below which no appreciable erosion takes place. The minimum shear stress can also be used to determine an erodability factor for the tested drilling fluid.

The drilling fluid used for drilling a well bore can be tested during the drilling process utilizing the apparatus and methods of this invention prior to or during the shutdown period to determine the minimum shear stress required to remove drilling fluid deposits from the walls of the well bore. The minimum shear stress can then be used to design an efficient deposit removal procedure which can be carried out prior to cementing. Also, the erodability factors for various types of drilling fluids can be determined for various types of drilling fluids using the apparatus and methods of this invention.

Thus, it is a general object of the present invention to provide improved test apparatus and methods for measuring the shear stress required at the walls of a well bore to remove drilling fluid deposits therefrom and/or for determining erodability factors for drilling fluids.

Other and further objects, features and advantages of the present invention will be readily apparent from the description of preferred embodiments which follows when taken in conjunction with the accompanying drawings.

DESCRIPTION OF PREFERRED EMBODIMENTS

In the drilling of oil and gas wells, the most commonly used technique utilizes a rotary drill bit connected to a string of drill pipe. The drill pipe and bit are rotated and a drilling fluid, generally an aqueous suspension including a clay such as bentonite and a particulate weighting material such as barite, is circulated downwardly through the drill pipe, through ports in the drill bit and then upwardly through the annulus between the drill pipe and the walls of the well bore to the surface. Cuttings produced by the drill bit are carried to the surface by the drilling fluid, and the cuttings and any gas contained in the drilling fluid are separated from the drilling fluid while it is on the surface before circulating it back into the well bore. A reservoir of circulating drilling fluid is maintained on the surface and the drilling fluid is pumped from the reservoir by circulating pumps back into the drill string. During drilling, the properties of the drilling fluid including viscosity and density are monitored to insure that the drilling fluid properties remain within desired limits. Also, during drilling and the circulation of drilling fluid through the well bore, fluid losses from the drilling fluid occur and filter cake is formed on the walls of the well bore.

When the well bore has been drilled to a desired depth, the drilling and the circulation of drilling fluid are terminated, and the drill pipe and drill bit are removed from the well bore. Subterranean formations penetrated by the well bore are usually then logged and pipe, e.g., casing, to be cemented in the well bore is run therein. The well bore is maintained filled with drilling fluid during this period in order to exert hydrostatic pressure on subterranean formations penetrated by the well bore to prevent blow-outs and the like.

Figure 1:
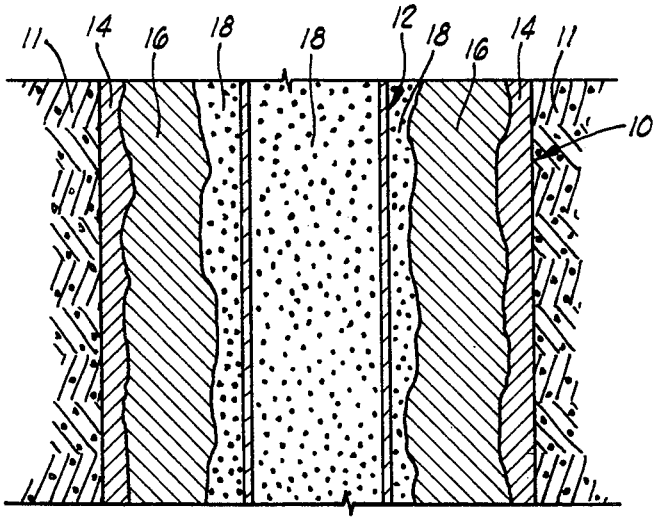
FIG. 1 is a schematic illustration of a portion of a well bore penetrating a permeable formation having drilling fluid deposits formed therein.

During the shut down period, i.e., the time that the drilling fluid remains in the well bore without being circulated, additional low viscosity fluid, i.e., water, is lost from the drilling fluid into permeable formations penetrated by the well bore and additional drilling fluid deposits are built up on the walls of the well bore. As shown in FIG. 1 which illustrates a well bore 10 containing a pipe 12 to be cemented therein, as a result of fluid loss during drilling and during the shut down period, a layer of filter cake 14 comprised of particulate weighting material and other solids from the drilling fluid is deposited on the walls of the well bore 10. During the shut down period, a layer of partially dehydrated gelled drilling fluid 16 is deposited on the filter cake 14. The formation of the partially dehydrated gelled drilling fluid is the result of a portion of the drilling fluid adjacent the filter cake 14 developing gel strength in the absence of shear and also losing a portion of its water to the permeable formation 11 penetrated by the well bore 10. In addition, moderately gelled drilling fluid 18 which also developed gel strength in the absence of shear during the shut down period is formed in the annulus adjacent to the partially dehydrated gelled drilling fluid 16 therein as well as in the interior of the pipe 12. Thus, during the shut down period and as a result of fluid loss to permeable formations penetrated by the well bore, additional filter cake and a layer of partially dehydrated gelled drilling fluid are deposited on the walls of the well bore, and the remaining drilling fluid in the annulus and inside the pipe becomes moderately gelled.

After the pipe to be cemented has been run into the well bore, a primary cementing procedure is carried out whereby the drilling fluid in the well bore is displaced out of the well bore by a cement slurry and one or more liquid spacers which are pumped downwardly through the pipe and then upwardly into the annulus between the pipe and the walls of the well bore. The cement slurry hardens into a substantially impermeable solid mass in the annulus which is intended to bond the pipe to the walls of the well bore and to seal the annulus whereby formation fluids are prevented from flowing in the annulus between subterranean zones penetrated by the well bore and/or to the surface.

In order to achieve a successful cement seal in the annulus, the drilling fluid including major portions of the filter cake and partially dehydrated gelled drilling fluid deposited on the walls of the well bore must be removed therefrom prior to when the cement slurry is placed in the annulus. If a substantial quantity of filter cake and gelled drilling fluid is allowed to remain on the walls of the well bore when the cement slurry is placed, the cement slurry will not bond to the walls of the well bore and the annulus will not be sealed.

The present invention provides test methods and apparatus for measuring the minimum shear stress required at the walls of a well bore to erode drilling fluid deposits therefrom. The minimum shear stress tests can be conducted for a particular drilling fluid being used to drill a well bore prior to when drilling fluid circulation is restarted after the shut down period so that the minimum shear stress required to remove the drilling fluid deposits is known. A knowledge of the shear stress required to remove the deposits allows a well bore cleaning procedure to be designed which will assure the removal of at least major portions of the drilling fluid deposits from the well bore prior to when a cement slurry is placed in the annulus of the well bore. The test methods and apparatus of this invention can also be utilized to determine erodability factors for various types of drilling fluids. By knowing the erodability factor of the type of drilling fluid used, the minimum shear stress required to be exerted on the walls of the well bore in order to remove drilling fluid deposits can be calculated.

The test methods of the present invention for measuring the minimum shear stress for removing drilling fluid deposits formed on the walls of a well bore containing a drilling fluid and penetrating one or more permeable formations basically comprise the following steps. A test portion of the drilling fluid is introduced into a test apparatus which simulates a permeable section of a well bore. The drilling fluid is maintained in a static state in the simulated permeable section at a pressure and for a time period such that fluid loss to the permeable section takes place and drilling fluid deposits comprised of filter cake, partially dehydrated gelled drilling fluid and moderately gelled drilling fluid are formed therein. The drilling fluid is next circulated through the simulated permeable section at progressively increasing flow rates with each of the flow rates being maintained for the time period required for the pressure drop of the drilling fluid through the permeable section to stabilize. The pressure drop through the permeable section is deemed to be stabilized when it changes less than about 0.2 psi during a circulation time period of about 10 minutes. During the drilling fluid circulation at each of the progressively increasing flow rates, the flow rate, the pressure drop, the viscosity, the temperature and the density of the drilling fluid are measured. In addition, the thicknesses of the drilling fluid deposits are acoustically measured during each of the flow rates, at least during the latter time period when the pressure drop stabilizes.

Upon completion of the drilling fluid circulation at progressively increasing flow rates, preferably at three or more flow rates, the stabilized pressure drop below which no appreciable erosion of the deposits on the walls of the simulated permeable section takes place is determined. This is accomplished by comparing the acoustically measured thicknesses of the drilling fluid deposits at the various drilling fluid circulation flow rates. The determination based on the acoustical measurements can be checked by calculating the well bore size equivalents to the stabilized pressure drops measured at each of the flow rates. The calculation of the well bore size equivalents to each of the measured stabilized pressure drops is performed in accordance with the following relationship:

$$D_e = \frac{2fLV^2\rho}{g_c\Delta p}$$

wherein:

$D_e$ is the equivalent diameter through which the drilling fluid is flowing;

f is the friction factor of the drilling fluid based on the drilling fluid viscosity and temperature;

L is the length of the flowing area;

V is the velocity of the drilling fluid;

$\rho$ is the drilling fluid density;

$g_c$ is the gravitational constant; and $\Delta p$ is the stabilized pressure drop across the length of the flowing area (L);

where the above variables are in consistent units.

Once the equivalent well bore sizes are calculated they are compared with each other and with the acoustically measured drilling fluid deposit thicknesses to determine the size and the corresponding stabilized pressure drop below which no appreciable erosion of the drilling fluid deposits takes place. That is, the stabilized pressure drop at which the drilling fluid deposits significantly decreased in thickness and at which the equivalent well bore size significantly increased as compared to lower stabilized pressure drops is the pressure drop at which significant erosion of the drilling fluid deposits first took place. The shear stress at the well bore wall corresponding to that pressure drop, i.e., the stabilized pressure drop below which no appreciable erosion takes place, is the minimum shear stress required to remove the drilling fluid deposits. That shear stress is calculated based on the following relationship:

$$\tau_w = \frac{D_e \Delta p_{bne}}{4L}$$

wherein:

$\tau_w$ is the minimum shear stress at the wall required to erode said drilling fluid deposits;

$D_c$ is the equivalent diameter through which the drilling fluid is flowing;

$\Delta P_{bne}$ is the pressure drop across the length of the flowing area (L) below which no appreciable erosion takes place; and L is the length of the flowing area;

where the above variables are in consistent units.

As indicated above, the shear stress calculated in accordance with the above relationship is the minimum shear stress required at the wall in order for the drilling fluid deposits to be eroded. Thus, the circulation of the tested drilling fluid in an actual well bore should be at a rate which is at least equal to and preferably greater than the corresponding flow rate to insure that a shear stress is exerted on the walls of the well bore which will erode the drilling fluid deposits thereon.

In order to convert the minimum shear stress determined above to a term which can be utilized to calculate the minimum shear stress of drilling fluids of the same general type, a term designated "erodability" which is inversely proportional to the minimum shear stress by a constant of proportionality equal to the yield stress of the closely packed particles in the drilling fluid deposits is defined by the following relationship:

$$E_{df} = \frac{1.991 \times 10^{24} Aa}{(4a^2)(12h^2)\tau_w}$$

wherein:

$E_{df}$ is the erodability of the drilling fluid deposits;

$\tau_w$ is the minimum shear stress at the wall required to erode the drilling fluid deposits;

A is $3 \times 10^{-20}$ joules;

a is the average radius of particles in the drilling fluid deposits; and h is the separation distance between the particle surfaces;

where the above variables are in consistent units.

Once the erodability factor of a particular type of drilling fluid has been determined, it can be used for calculating the shear stress required at the walls of a well bore to remove drilling fluid deposits therefrom based on the estimated mean particle diameter of the solids in the drilling fluid which are closely packed in the deposits formed therefrom and the estimated separation distance between the surfaces of such particles. For example, in an aqueous bentonite clay drilling fluid containing barite particles having a mean particle diameter of about 10 micrometers, the mean particle diameter (a) of solids making up the drilling fluid will usually not be less than about 1 micrometer and the distance between particles (h) will not be less than about 0.2 micrometer. Thus, if the erodability ($E_{df}$) is known for one aqueous bentonite drilling fluid, the shear stress at the wall required to remove deposits formed by other aqueous bentonite drilling fluids can be determined from the above relationship based on the average particle radius and spacing between particles of the solids in the drilling fluid.

In a preferred drilling fluid testing method of this invention, the drilling fluid introduced into the test apparatus is circulated through the simulated permeable well bore section at a selected flow rate and for a time period whereby the pressure drop of the drilling fluid through the permeable section stabilizes prior to maintaining the drilling fluid in a static state in the permeable section. This initial circulation, which is generally within the range of from about 0.5 bpm to about 5 bpm, simulates the circulation of the drilling fluid through a well bore as it is being drilled and produces an initial filter cake deposit on the walls of the well bore.

While the permeability of the simulated permeable well bore section of the test apparatus can be varied, a permeable medium such as a fine mesh screen or porous rock, e.g., sandstone, is generally used having a permeability in the range of from about 20 millidarcies to about 1000 millidarcies. During the static state formation of drilling fluid deposits on the walls of the simulated permeable section, the drilling fluid is maintained in the permeable section in a static state for a time period in the range of from about 4 hours to about 48 hours, and pressure is exerted on the drilling fluid in an amount in the range of from about 100 psig to about 500 psig which results in about the same pressure differential being exerted across the simulated formation. As mentioned above, the drilling fluid deposits are primarily formed as a result of fluid loss from the drilling fluid taking place, and such fluid loss through the simulated permeable well bore section can be collected and measured. As the drilling fluid deposits are formed, the rate of fluid loss decreases, and the substantial reduction or termination of fluid loss during the static state period is an indication that deposits have been formed.

As indicated above, after the deposits are formed in the test permeable section, drilling fluid is circulated through the section at progressively increasing flow rates, preferably at three or more flow rates. The particular progressively increasing circulation flow rates selected should span the range of drilling fluid pumping rates available at the particular drilling site involved or the pumping rates which are generally available in drilling operations, e.g., flow rates ranging from a low of about 0.5 bpm to a high of about 5 bpm.

As will now be understood, the testing methods of the present invention can be utilized to test specific drilling fluids being used at the time or to test various general types of drilling fluid so that the erodability factors for each type are known. The erodability factors can be used to estimate the minimum shear stress required at the walls of a well bore to erode drilling fluid deposits formed thereon based on particle size and spacing estimations. The most accurate and preferred technique for utilizing the testing methods of this invention is to test particular drilling fluids being utilized in the drilling of well bores to determine the minimum shear stress required to erode deposits formed therefrom. For example, when the drilling is completed and the circulation of drilling fluid is shutdown, a sample of the drilling fluid from the well site can be tested to determine the minimum shear stress at the wall required to remove deposits formed from the drilling fluid. Once the minimum shear stress is known, a drilling fluid water spacer circulation rate for cleaning up the well bore after the shut down period and prior to cementing can be used which results in the shear stress required to remove the deposits. If the shear stress required can not be reached by circulating only drilling fluid and a conventional spacer, one or more special liquid spacers can be pumped through the well bore which have viscosity and/or other properties whereby the shear stress required to remove the drilling fluid deposits is exerted on the well bore thereby. Other techniques can also be used in combination with drilling fluid and/or spacer circulation which are well known to those skilled in the art such as rotating or reciprocating the pipe to be cemented while the circulation takes place, employing mechanical scrapers and the like.

Figure 2:
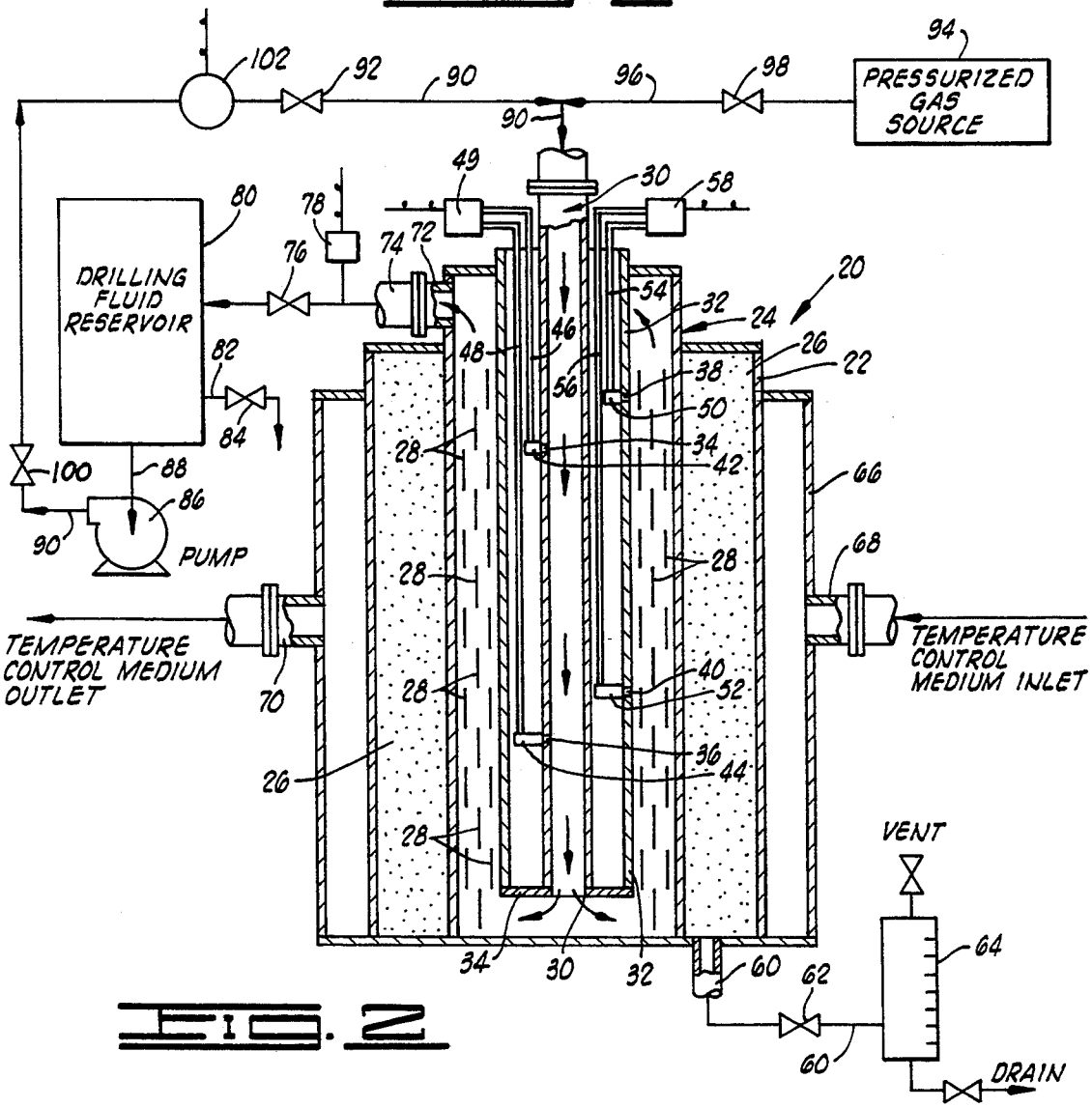
FIG. 2 is a partially schematic and partially cross-sectional view of a test apparatus which can be utilized for carrying out the methods of this invention.

Referring now to FIG. 2, a test apparatus is illustrated and designated by the numeral 20. The test apparatus 20 is comprised of a container 22 having a first pipe 24 disposed therein. The container 22 and the pipe 24 are preferably cylindrical, and the pipe 24 is preferably concentrically positioned within the container 22. Disposed within the container 22 in the space between the interior thereof and the exterior of the pipe 24 is a permeable media 26 such as packed sand which has a permeability simulating that of a subterranean permeable formation, i.e., a permeability in the range of from about 20 millidarcies to about 1000 millidarcies. The pipe 24 includes a plurality of slots 28 or other openings formed therein, and the interior of the pipe 26 in combination with the slots 28 and permeable media 26 simulate the walls of a well bore penetrating a permeable subterranean formation, i.e., a permeable well bore section. A second pipe 30 is positioned within the first pipe 24 which simulates a conduit to be cemented within a well bore. The first pipe 24 has a closed lower end which simulates the bottom of a well bore and the second pipe 30 has an open lower end positioned a short distance above the bottom of the pipe 24.

In the embodiment illustrated in FIG. 2, a third pipe 32 is disposed around the exterior of the pipe 30 and the annular space between the exterior of the pipe 30 and the interior of the pipe 32 is sealed at the bottom ends of the pipes 30 and 32 by an annular plate 33 connected thereto. The upper end of the annular space between the pipes 30 and 32 is open. A pair of longitudinally spaced orifices 34 and 36 are disposed in the pipe 30 and a pair of longitudinally spaced orifices 38 and 40 are disposed in the pipe 32. The orifices 34 and 36 in the pipe 30 are connected by fittings 42 and 44 to conduits 46 and 48, respectively, disposed within the annular space between the pipes 30 and 32. The conduits 46 and 48 are connected to a pressure differential transducer 49 which is in turn operably connected to a computer (not shown) for continuously monitoring pressure differential and other aspects of the operation of the apparatus 20. The ports 38 and 40 are connected to fittings 50 and 52 which are in turn connected to conduits 54 and 56, respectively. The conduits 54 and 56 are connected to a second pressure differential transducer 58 which is also operably connected to the above mentioned computer. Fluid which enters the permeable medium 26 within the container 22 can be withdrawn from the container 22 by way of a conduit 60 which is connected to an opening in the bottom of the container 22. The conduit 60 has a shut off valve 62 disposed therein and is connected to a fluid volume indicating accumulator 64.

A temperature control medium jacket 66 is attached to the exterior of the container 22. The jacket 66 has an inlet 68 and an outlet 70 whereby a temperature controlled medium can be circulated at a controlled rate through the jacket 66. As will be understood, the circulation rate of the temperature control medium through the jacket 66 is controlled by temperature control system (not shown) whereby the temperature of the apparatus 20 and drilling fluid circulating therethrough are controlled at desired levels.

The first pipe 24 which in combination with the medium 26 simulates a permeable well bore section is sealingly connected to a drilling fluid outlet connection 72. A conduit 74 is connected to the outlet connection 72 having a shut off valve 76 disposed therein. A temperature transducer 78 is connected to the conduit 74 for sensing the temperature of drilling fluid flowing therethrough, and the transducer 78 is also connected to the above mentioned computer. The conduit 74 is connected to a drilling fluid reservoir 80 having a drilling fluid sample connection 82 and valve 84 attached thereto. A drilling fluid circulation pump 86 is connected to an outlet connection in the drilling fluid reservoir by a conduit 88. The discharge connection of the pump 86 is sealingly connected to the upper end of the second pipe 30 by a conduit 90 having a flow control valve 100, a flow meter 102 and a shut off valve 92 disposed therein. The flow meter 102 is also operably connected to the above mentioned computer. A pressure regulated pressurized gas source 94, e.g., nitrogen, is connected to a conduit 96 which is in turn connected to the conduit 90. A shut off valve 98 is disposed in the conduit 96.

In operation of the test apparatus 20, a drilling fluid to be tested is pumped from the reservoir 80 by the pump 86 through the conduit 90 and downwardly through the pipe 30. The pipe 30 simulates a pipe disposed in a well bore to be cemented therein. The drilling fluid flows through the open bottom end of the pipe 30 and upwardly in the annulus between the exterior of the pipe 32 and the interior of the pipe 24 which simulates the walls of a well bore. The drilling fluid flows out of the annulus by way of the conduit 74 which conducts the drilling fluid back to the reservoir 80. The flow rate of the circulating drilling fluid is controlled by a flow control valve 100 disposed in the conduit 90, and the flow rate of the circulating drilling fluid is indicated by the flow meter 102 disposed in the conduit 90. The pressure drop of the circulating drilling fluid through the interior of the pipe 30 is communicated from the ports 34 and 36 therein to the pressure differential transducer 48 by the conduits 44 and 46. In a like manner, the pressure drop of the drilling fluid flowing through the annulus between the pipes 24 and 32 is communicated by the ports 38 and 40 and conduits 54 and 56 to the pressure differential transducer 58. The temperature of the drilling fluid exiting the simulated permeable well bore section of the apparatus 20 is sensed by the temperature transducer 78. As mentioned above, the flow rate, pressure drops and temperature of the drilling fluid are continuous monitored by a computer. Also, the fluid loss rate measured by means of the accumulator 64 and the drilling fluid viscosity and density measurements made periodically from samples withdrawn from the reservoir 82 by way of the sample connection 82 are input to the computer.

When it is desired to stop the circulation of the drilling fluid through the pipes 24 and 30 and to maintain the drilling fluid therewithin in a static state and under pressure, the pump 86 is stopped and the shut off valves 76 and 92 in the conduits 74 and 90, respectively, are closed. Pressurized gas is then exerted on the drilling fluid by opening the valve 98 disposed in the conduit 96. The particular pressure of the gas is adjusted by a conventional pressure regulator at the pressurized gas source (not shown).

When it is desired to measure the rate and volume of fluid loss from the drilling fluid, i.e., water which flows through the slots 28 in the pipe 24 and through the permeable medium 26 within the container 22, the valve 62 in the conduit 60 is opened whereby the fluid flows into the volume indicating container 64. As previously indicated, a temperature control medium such as heated or cooled water is flowed through the temperature control jacket 66 to maintain the temperature of the apparatus 20 and the drilling fluid flowing therethrough at a desired level.

Figure 9:
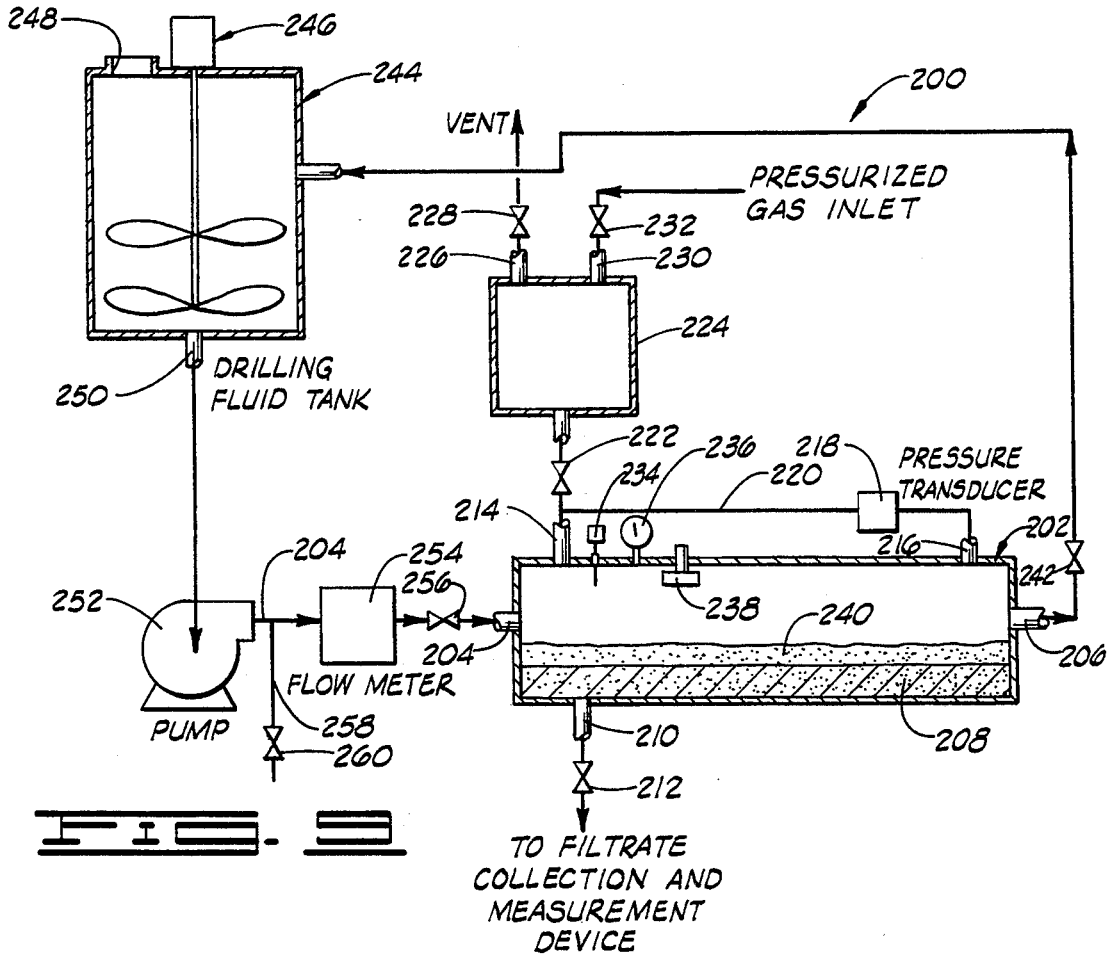
FIG. 9 is a partially schematic and partially cross-sectional view of an improved test apparatus for carrying out the methods of this invention.

Referring now to FIG. 9, an improved test apparatus of the present invention is illustrated and generally designated by the numeral 200. The test apparatus 200 is of a smaller and simpler design than the test apparatus 20, and lends itself to being portable whereby it can conveniently be moved from well site to well site and used to test the drilling fluid being utilized at each site. The test apparatus 200 is comprised of a container 202 which simulates a well bore. That is, the container 202 is closed and includes inlet and outlet drilling fluid conduits 204 and 206, respectively, connected at opposite ends thereof. An elongated block of permeable sandstone 208 is disposed in the bottom of the container 202 for simulating a permeable subterranean formation, and a fluid loss outlet conduit 210 is connected to the bottom of the container 202 for removing liquid filtrate which flows through the permeable sandstone 208. The conduit 210 is connected to a shut-off valve 212 which is in turn connected to a filtrate collection and measurement device (not shown) such as the device 64 described above. A conduit 214 is connected to the top of the container 202 at one end thereof and a conduit 216 is connected thereto at the other end. The conduit 216 is connected to a pressure transducer 18 and a conduit 220 connects the pressure transducer 218 to the conduit 214. The pressure transducer 218 senses the pressure differential within the container 202 when drilling fluid is circulated therethrough. The pressure transducer 218 is operably connected to a signal processing computer (not shown) for continuously monitoring pressure differential and other aspects of the operation of the apparatus 200 as will be described hereinbelow.

The conduit 214 has a shut-off valve 222 disposed therein and is connected to the bottom of a closed tank 224. A conduit 226 for venting the tank 224 is connected to the top thereof and a shut-off valve 228 is disposed in the conduit 226. Another conduit 230 is connected to the top of the tank 224 and to a source of pressurized gas such as air or nitrogen. A shut-off valve 232 is disposed in the conduit 230. A temperature transducer 234 is connected to the top of the container 202 for sensing the temperature of drilling fluid flowing therethrough, and the transducer 234 is connected to the above-mentioned computer. A pressure gauge 236 is connected to the container 202 for visually indicating the pressure therein, and an acoustic drilling fluid deposit thickness measuring device 238 is disposed within the container 202. The acoustic device 238 transmits an acoustic signal, generally in the ultrasonic range, through drilling fluid deposits 240 formed on the porous media 208. The device receives return reflection signals and the signals are conducted to the above-mentioned computer. The computer calculates the thickness of the drilling fluid deposit by multiplying the signal travel time by the velocity of the signal divided by 2.

The drilling fluid outlet conduit 206 connected to the container 202 has a shut-off valve 242 disposed therein and is connected to a drilling fluid reservoir tank 244. The tank 244 includes a paddle stirrer 246 and a drilling fluid inlet opening 248. An outlet conduit 250 is connected to the bottom of the tank 244 and to the suction connection of a pump 252. The discharge connection of the pump 252 is connected to the conduit 204 which is in turn connected to the inlet end of the container 202. A flow meter 254 and a shut-off valve 256 are disposed in the conduit 204. The flow meter is operably connected to the above-mentioned computer. A conduit 258 is connected to the conduit 204 for withdrawing samples of the drilling fluid whereby its properties can be determined, e.g., viscosity and density. A shut-off valve 260 is disposed in the conduit 258.

In operation of the test apparatus 200, a drilling fluid to be tested is pumped from the reservoir within the tank 244 by the pump 252 through the flow meter 254 by way of the conduit 204 into the container 202. The drilling fluid is discharged from the container by way of the conduit 206 from where it flows back to the tank 244. The flow rate of the circulating drilling fluid is controlled by the flow control valve 256 in the conduit 204 and the flow rate is indicated by the flow meter 254 also disposed in the conduit 204. The pressure drop of the circulating drilling fluid through the interior of the container 202 is communicated by the conduits 214, 216 and 220 to the differential pressure transducer 218. The pressure differential is continuously transmitted to the computer as is the temperature of the circulating drilling fluid sensed by the temperature transducer 234. Thus, the flow rate, pressure drop and temperature are continuously monitored by the computer.

As the drilling fluid flows through the container 202, fluid is lost through the porous sandstone 208 and removed from the container 202 by way of the conduit 210. The loss of the liquid filtrate through the sandstone 208 causes a drilling fluid deposit to be formed on the surface of the permeable medium 208. The fluid loss rate is measured by a filtrate collection and measurement device connected to the conduit 210 (not shown), and samples of the drilling fluid are periodically withdrawn by way of the conduit 258 on which viscosity and density measurements are made. The viscosity and density measurement data is transmitted to the computer. Finally, the acoustic drilling fluid deposit thickness measuring device 238 transmits and receives acoustic signals which pass through the drilling fluid deposits. The signals are transmitted to the computer whereby they are processed and the thickness of the drilling fluid deposits determined.

In a preferred method of operating the test apparatus 200, a drilling fluid to be tested is introduced into the tank 44 and into the container 202 as well as the other components of the test apparatus. The drilling fluid is preferably initially circulated through the container 202 at a first selected flow rate for a time period whereby the pressure drop of the drilling fluid through the container 202 and over the permeable section therein stabilizes. During this initial circulation an initial drilling fluid deposit 240 is formed on the porous medium 208, the thickness of which is continuously measured by the acoustic thickness measuring device 238. The circulation of the drilling fluid is terminated by stopping the pump 252. The valve 242 is closed and the valves 222 and 228 are opened. The pump 252 is started and the valve 256 is manipulated to pump additional drilling fluid into the container 202 which forces drilling fluid into the tank 224 by way of the conduit 214 and open valve 222. When the tank 224 is partially filled with drilling fluid, the pump 252 is stopped and the valve 256 is closed as is the vent valve 228. The valve 232 is next opened whereby pressurized gas is caused to enter the tank 224 and a gas pressure is exerted on the drilling fluid in the tank 224 and in the container 202. The liquid filtrate valve 212 is open whereby liquid filtrate passing through the porous medium 208 is withdrawn and additional drilling fluid deposits are formed on the surface of the porous media 208 as previously described above. The valve 222 is closed, the valves 242 and 256 are opened and the pump 252 is started. The drilling fluid is circulated through the container 202 at progressively increasing flow rates and each of the flow rates is maintained for a time period whereby the pressure drop of the drilling fluid through the container 202 stabilizes. As previously described, the flow rate, pressure drop, the viscosity, the temperature and the density of the drilling fluid are continuously measured as is the thickness of the drilling fluid deposits 240 on the porous medium 208. The stabilized pressure drop below which no appreciable erosion of the deposits takes place is determined by comparing the acoustically measured thicknesses of the drilling fluid deposits during the circulation of the drilling fluid at each of the flow rates when the pressure drop stabilizes.

As mentioned above, the stabilized pressure drop below which no appreciable erosion of the deposits takes place can be and is preferably checked by calculating the well bore size equivalents to the stabilized pressure drops measured at each of the flow rates and comparing them with each other and with the acoustically measured thicknesses of the drilling fluid deposits. Once the stabilized pressure drop below which no appreciable erosion of the deposits takes place is determined, the minimum shear stress required to erode the drilling fluid deposits can be determined as can the erodability of the drilling fluid tested.

Figure 10:
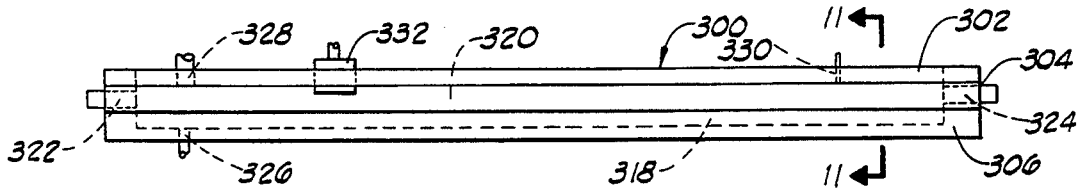
FIG. 10 is a side elevational view of an alternate form of the container of the present invention which simulates a permeable section of a well bore.
Figure 11:
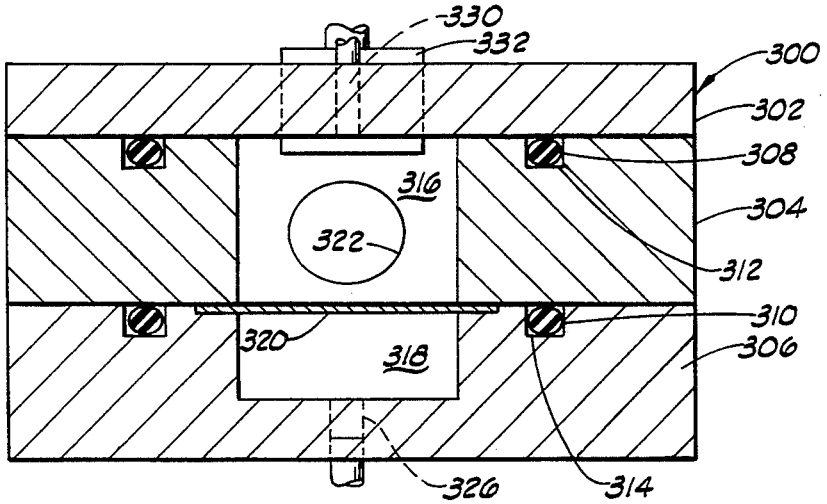
FIG. 11 is a cross-sectional view taken along line 11—11 of FIG. 10.

Referring now to FIGS. 9 and 10, a preferred form of the container which simulates a well bore and which contains a permeable medium for simulating a permeable subterranean formation is illustrated and generally designated by the numeral 300. The container 300 is comprised of a top member 302, an intermediate member 304 and a bottom member 306 which are clamped together and sealed by means of O-ring seal members 308 and 310 positioned in grooves 312 and 314 formed in the top surfaces of the members 304 and 306, respectively. The intermediate member 304 includes a central cavity 316 and the bottom member 306 includes a complimentary liquid filtrate collecting cavity 318. The cavity 316 simulates a well bore and a fine mesh screen 320 simulating a permeable formation is disposed between the members 304 and 306 and between the cavities 316 and 318. Inlet and outlet conduit connections 322 and 324, respectively, are attached to the ends of the intermediate member 304 whereby they communicate with the cavity 316. A liquid filtrate collection conduit connection 326 is provided in the bottom of the member 306 and pressure drop transmitting conduit connections 328 and 330 are provided in the top member 302. An acoustic drilling fluid deposit thickness transducer 332 is sealingly connected to an opening in the top member 302. The container apparatus 300 can be substituted for the container 202 illustrated in FIG. 9, and provides the advantage that it can be quickly disassembled and cleaned between tests and is of a relatively compact portable design. The operation of the container 300 is identical to the operation of the container 202 described above.

In order to further illustrate the methods and apparatus of the present invention, the following examples are given.

EXAMPLE 1

A 17 pound per gallon (ppg) aqueous bentonite drilling fluid containing about 95% by weight particulate barite solids was tested using apparatus like that illustrated in FIG. 2. The pressure drop within the pipe 30 simulating the conduit to be cemented and within the space between the pipes 24 and 32 simulating the annulus in a permeable well bore section were continuously measured and recorded. The distance between the pressure ports 34 and 36 in the pipe 30 was 6 feet as was the distance between the pressure ports 38 and 40 in the pipe 32. In addition to the pressure drops, the flow rate and temperature of the circulating fluid were continuously, measured and recorded. Also, samples of circulating drilling fluid were periodically taken and the density and viscosity (theology) thereof were determined and recorded. The fluid loss from the drilling fluid was also measured and recorded periodically.

Prior to circulating drilling fluid, the test apparatus was calibrated by pumping fresh water in turbulent flow at various flow rates therethrough. The measured pressure drops of the water were then compared with calculated pressure drops based on the equation:

$$\Delta p = \frac{2fLV^2\rho}{g_c D_e}$$

wherein:

f is the friction factor,

L is the length between pressure ports,

V is the velocity of the fluid, $\rho$ is the density of the fluid, $D_e$ is the equivalent diameter, and $g_c$ is the gravitational constant.

Referring to FIG. 2, when the fluid is flowing through the pipe 30 of the apparatus 20, then $D_e$ in the above equation is the inside diameter of the pipe 30. When the fluid is flowing through the annulus then $D_e$ in the equation is the inside diameter of the pipe 24 minus the outside diameter of the pipe 32. The inside diameter of the pipe 30 was 1.925", and the pressure drops in the pipe 30 at flow rates of 2.97 barrels per minute (bpm), 4.06 bpm and 5.06 bpm were calculated using the above equation. The calculated pressure drops are compared with the measured pressure drops in Table I below.

TABLE I

Pressure Drops in the Pipe 30 for Water.

| Flow Rate (bpm) | Measured Pressure Drop (psi/6 ft) | Calculated Pressure Drop (psi/6 ft) |
|---|---|---|
| 2.97 | 0.756 | 0.750 |
| 4.06 | 1.295 | 1.321 |

TABLE I-continued

| Pressure Drops in the Pipe 30 for Water. | | |
|---|---|---|
| Flow Rate (bpm) | Measured Pressure Drop (psi/6 ft) | Calculated Pressure Drop (psi/6 ft) |
| 5.06 | 1.916 | 1.960 |

The inside diameter of the pipe 24 was 6.5" and the outside diameter of the pipe 32 was 5". The pressure drops in the annulus were calculated and they are compared with the measured pressure drops in Table II below.

TABLE II

| Pressure Drops in the Annulus for Water | | |
|---|---|---|
| Flow Rate (bpm) | Measured Pressure Drop (psi/6 ft) | Calculated Pressure Drop (psi/6 ft) |
| 2.97 | 0.063 | 0.065 |
| 4.06 | 0.118 | 0.114 |
| 5.06 | 0.183 | 0.168 |

As shown in Tables I and II there was good agreement between the measured and the calculated pressure drops.

Drilling fluid was next circulated through the apparatus 20 at a rate of 2.05 bpm for about 10 minutes and then at a rate of 4.12 bpm for about 10 minutes followed by circulating the drilling fluid for about 1 hour each at the rates of 1 bpm, 2.9 bpm and 5 bpm. The fluid lost from the drilling fluid was measured during the periods when the drilling fluid was circulated at 1 bpm, 2.9 bpm and 5 bpm rates.

The properties of the drilling fluid are given in Table III below, and the flow rates, measured pressure drops and calculated pressure drops are given in Table IV below.

TABLE III

| Properties of 17.0 ppg Drilling Fluid at 110° F. | |
|---|---|
| Type | Water Based |
| Major Solids | 95% by Weight Barite |
| Mean Barite Particle Diameter | 10 μm |
| Estimated Smallest Particle Size of Solids | 1 μm |
| Plastic Viscosity (cp) | 54.4 |
| Yield Point (lbf/100 ft$^2$) | 11.4 |
| 10 sec Gel Strength (lbf/100 ft$^2$) | 4 |
| 10 min Gel Strength (lbf/100 ft$^2$) | 17 |
| API Fluid Loss (cc/30 min) | 9 |

TABLE IV

| Pressure Drops in the Pipe and Annulus - Drilling Fluid | | | | |
|---|---|---|---|---|
| Flow Rate (bpm) | Measured Pressure Drop in the Pipe (psi/6 ft) | Calculated Pressure Drop in the Pipe (psi/6 ft) | Measured Pressure Drop in the Annulus (psi/6 ft) | Calculated Pressure Drop in the Annulus (psi/6 ft) |
| 2.05 | 1.38 | 1.43 | 0.33 | 0.39 |
| 4.12 | 4.61 | 4.43 | 0.57 | 0.57 |
| 1 | 0.41 | 0.41 | 0.23 | 0.30 |
| 2.9 | 2.73 | 2.53 | 0.51 | 0.47 |
| 5 | 6.29 | 6.08 | 0.74 | 0.65 |

From the above, it can be seen there is good agreement between the calculated and measured pressure drops at the flow rates of 2.05 bpm and 4.12 bpm. The calculated pressure drop at 1 bpm is higher than the measured value in the annulus This is due to fluid loss to the simulated formation as result of opening the valve 62 for the first time.

Figure 3:
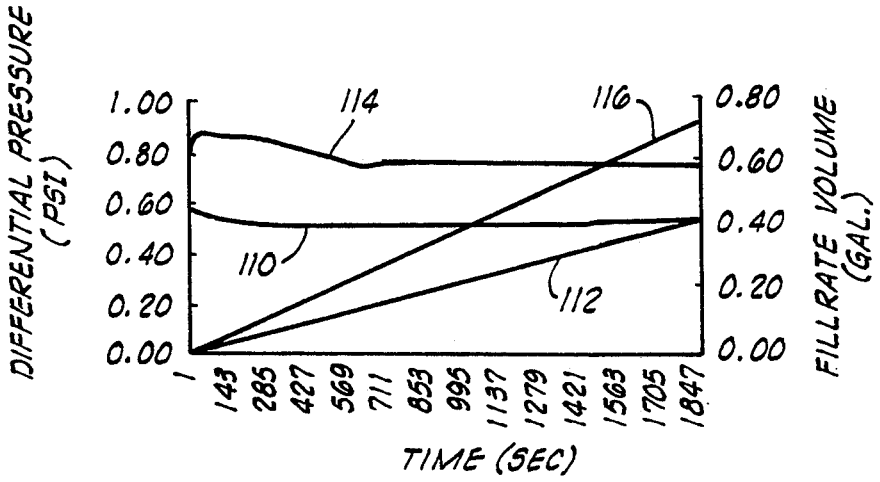
FIG. 3 is a graph showing annulus differential pressures and fluid losses for a drilling fluid circulated at different rates in apparatus like that illustrated in FIG. 2.

Referring now to FIG. 3, the measured pressure drop in the annulus at the flow rate of 2.9 bpm is shown by the curve 110 and the volume of fluid lost from the drilling fluid over time at that rate is shown by the curve 112. The pressure drop in the annulus at the flow rate of 5 bpm is shown by the curve 114 and the volume of fluid loss over time is shown by the curve 116. The slopes of the fluid loss curves 112 and 116 are almost constant, and the pressure drops in the annulus as shown by the curves 110 and 114 increase slightly and then become almost constant. This indicates that at the flow rates of 2.9 bpm and 5 bpm a thin filter cake was deposited and as additional filter cake deposited it was eroded away at almost the same rate as it was deposited. It is believed that as shown in Table 4, the measured pressure drop in the annulus was slightly higher than the calculated pressure drop at the flow rates 2.9 bpm and 5 bpm because of the deposition of the filter cake.

Following a total of three hours during which the drilling fluid was circulated as described above, the pump 86 was shut off, the valves 76 and 92 in the conduits 74 and 90 were closed and the valve 98 in the conduit 96 was open so that a pressure of 100 psig was exerted on the drilling fluid within the apparatus 20. The drilling fluid was maintained within the apparatus 20 at a pressure of 100 psig and in a static state for about 18 hours during which time the valve 62 was open and fluid lost from the drilling fluid was collected and measured. The shut down simulated the shut down period in the drilling of a well bore during which drilling fluid deposits of filter cake and gelled drilling fluid are formed on the walls of the well bore.

Figure 4:
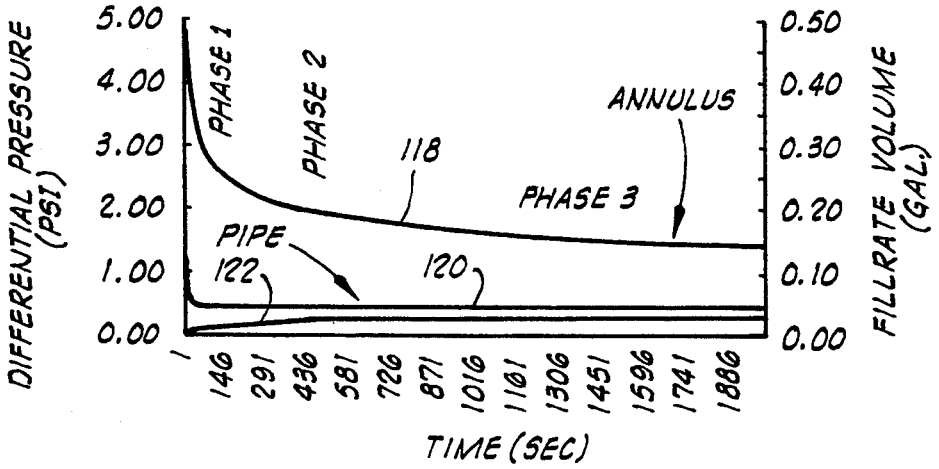
FIG. 4 is a graph showing differential pressures in the pipe and annulus and fluid loss for a drilling fluid circulated in test apparatus like that shown in FIG. 2 after drilling fluid deposits were formed therein.

After the shut down, the valve 98 was shut off and the valves 76 and 92 were opened. Circulation of drilling fluid was then started by starting the pump 86 and the flow rate was adjusted to 1 bpm. The measured pressure drops in the annulus and inside the pipe as well as the volume of fluid lost from the drilling fluid as a function of time are shown in FIG. 4. That is, the pressure drop in the annulus is shown by the curve 118, the pressure drop in the pipe is shown by the curve 120 and the fluid loss is shown by the curve 122. As illustrated in FIG. 4, the pressure drop in the pipe started at a high value of 1.75 psi and then decreased linearally to about 0.5 psi in about 25 seconds. The pressure drop then decreased to about 0.44 psi and remained relatively constant at that value. The pressure drop in the annulus showed three distinct phases indicated in FIG. 4 as "Phase 1", "Phase 2" and "Phase 3". In Phase 1, the pressure drop started at a high value of 4.75 psi and decreased linearally to about 3.0 psi in about 36 seconds. This phase was similar to the initial 25 seconds of pressure drop for the flow inside the pipe. In Phase 2, the pressure drop in the annulus decreased from about 3.0 psi to about 2.0 psi in a quadratic fashion in about 350 seconds. During Phase 3, the rate of decrease in pressure drop was slow as it decreased linearally from 2.0 psi to 1.4 psi in about 1600 seconds. During the drilling fluid circulation very little fluid loss took place.

The reasons for the pressure drop behavior shown in FIG. 4 are that during the shut down period the drilling fluid inside the pipe developed moderate gel strength in the absence of shear, filter cake was deposited on the walls of the simulated well bore and drilling fluid inside the annulus close to the wall developed gel strength in the absence of shear and lost fluid to the formation whereby it was partially dehydrated. When the circulation of drilling fluid was started at 1 bpm, it first had to displace the moderately gelled drilling fluid in the pipe and in the annulus. Hence, the pressure drop in the pipe started out at a high of 1.75 psi and decreased in the first 25 seconds to 0.5 psi during which the moderately gelled drilling fluid was displaced from the pipe. The calculated pressure drop for the drilling fluid flowing through the pipe was 0.43 psi. This was in close agreement with the measured steady state value of 0.44 psi inside the pipe. These values are tabulated in Table V set forth below. As concerns the annulus, Phase 1 (36 seconds during which the pressure drop in the annulus decreased linearally from a 4.75 psi to about 3.0 psi) is the time required for the moderately gelled drilling fluid to be displaced from the annulus. The decreases in pressure drop in the annulus in Phase 2 and Phase 3 are attributed to the erosion of the partially dehydrated gel drilling fluid and filter cake deposits on the walls of the simulated well bore. As the erosion took place, the area available for flow increased and as a consequence, the pressure drop lowered and the shear stress at the wall decreased. Thus, the slow rate of erosion in Phase 3 is attributable to the decrease in shear stress on the deposits. The little or no fluid loss to the formation during the time the drilling fluid was circulated at 1 bpm is attributable to a high resistance due to the deposits and a low driving force for fluid loss.

Figure 5:
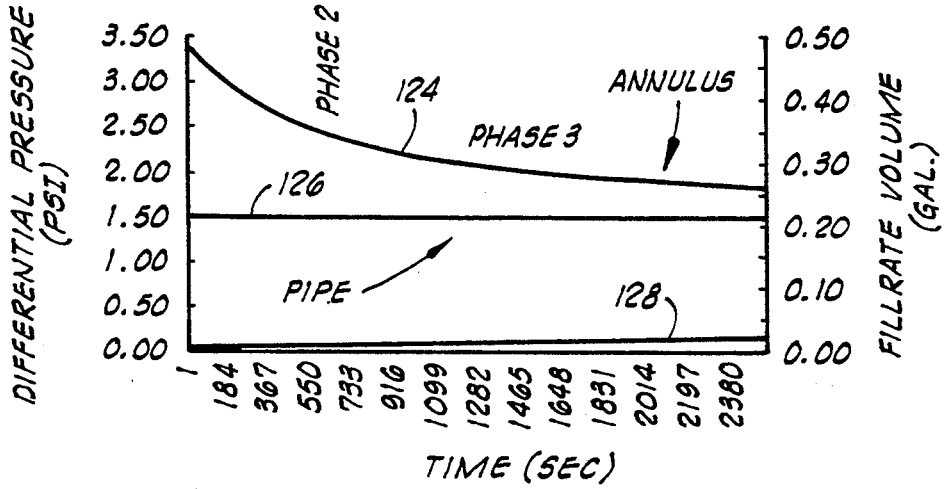
FIG. 5 is a graph similar to FIG. 4 showing additional pipe and annulus differential pressures and fluid losses.

When the pressure drop in the annulus reached a near constant value (stabilized) at a flow rate of 1 bpm, the drilling fluid circulation rate was increased to 2 bpm. The graph of FIG. 5 shows the pressure drops in the annulus (curve 124) and the pipe (curve 126) as well as the fluid loss from the drilling fluid (curve 128). As indicated in FIG. 5, the pressure drop in the pipe remained constant during circulation at 2 bpm. This is because the moderately gelled drilling fluid inside the pipe was removed during the first 25 seconds of circulation at 1 bpm. As shown in Table V, there was a satisfactory agreement between the measured and calculated pressure drops inside the pipe. Again referring to FIG. 5, there was no Phase 1 type of pressure drop behavior in the annulus because the moderately gelled drilling fluid in the annulus was removed during the first 36 seconds of circulation at 1 bpm. The Phase 2 type of behavior in the annulus is shown by the annulus curve 124, i.e., the annulus pressure drop decreased quadratically for the first 500 seconds. During this period the partially dehydrated gelled drilling fluid and filter cake deposits were being eroded. The increase in erosion is attributed to the increase in shear stress at the wall as the flow rate was increased from 1 bpm to 2 bpm. In Phase 3 as shown by the curve 124, the rate of decrease in pressure drop was slow for the same reason as given above relating to the 1 bpm circulation.

Figure 6:
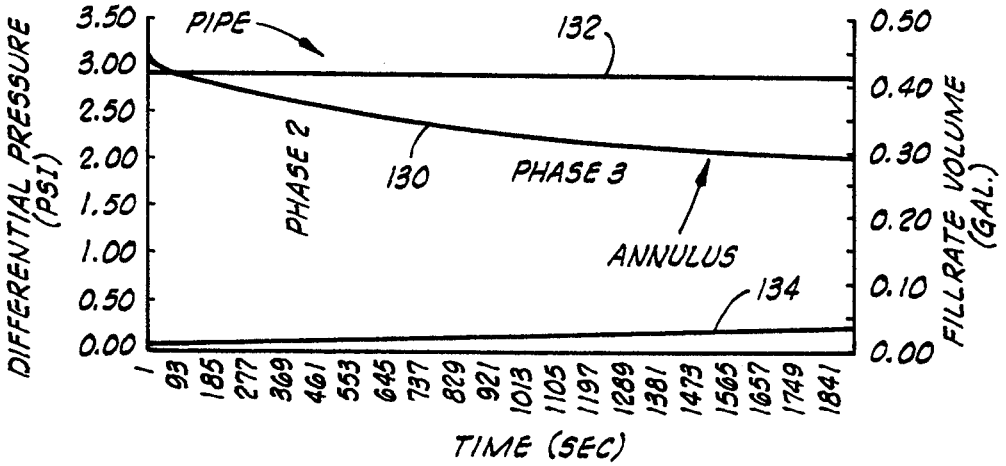
FIG. 6 is a graph similar to FIG. 4 showing additional pipe and annulus differential pressures and fluid losses.

The drilling fluid circulation rate was again increased to 3 bpm. The measured pressure drop in the annulus (curve 130), inside the pipe (curve 132) and the volume of lost fluid as a function of time (curve 134) are shown in the graph of FIG. 6. A comparison of FIG. 5 to FIG. 6 shows that at a drilling fluid flow rate of 3 bpm, the pressure drop and fluid loss behavior is essentially the same as the behavior at a flow rate of 2 bpm.

Figure 7:
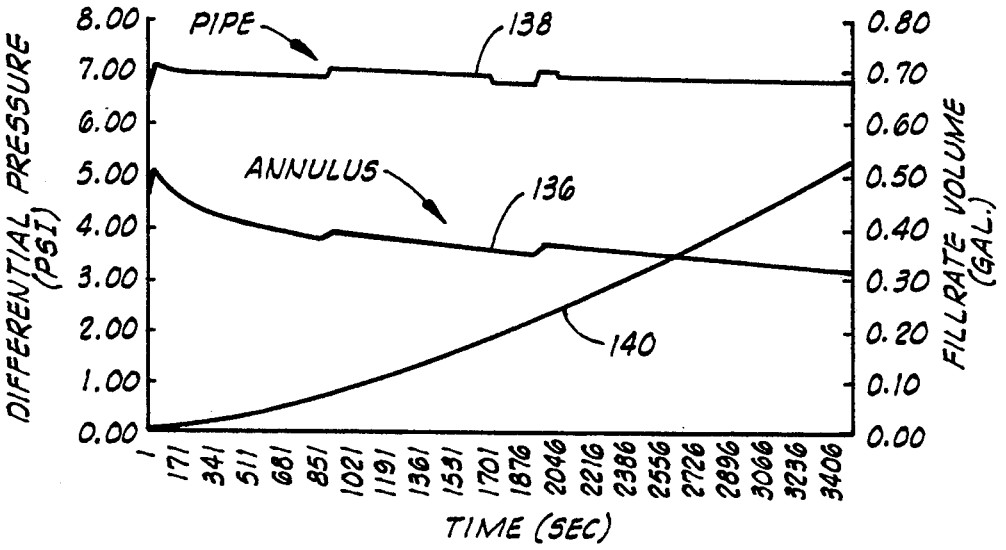
FIG. 7 is a graph similar to FIG. 4 showing additional pipe and annulus differential pressures and fluid losses.

The circulation of drilling fluid was again increased to 5 bpm. The measured pressure drop in the annulus (curve 136), inside the pipe (curve 138) and the volume of fluid lost as a function of time (curve 140) at 5 bpm are shown by the graph of FIG. 7. As curve 138 of FIG. 7 indicates, the pressure drop inside the pipe was again basically constant. As shown in Table V, there was satisfactory agreement between the measured and calculated pressure drops. Curve 136 shows that at 5 bpm, the pressure drop in the annulus decreases with time while as shown by curve 140, measurable amounts of fluid loss took place. The reason there was significant fluid loss at 5 bpm is that the driving force for fluid loss, i.e., the pressure differential across the formation was higher than was the case at the previously lower flow rates. The fluid loss to the formation brought about the deposit of new filter cake but the rates of erosion and deposition at 5 bpm were almost the same.

The measured and calculated pressure drops in the pipe at the various flow rates described above are shown in Table V below.

TABLE V

Pressure Drop in the Pipe Drilling Fluid

| Flow Rate (bpm) | Measured Pressure Drop (psi/6 ft) | Calculated Pressure Drop (psi/6 ft) |
|---|---|---|
| 1.07 | 0.44 | 0.43 |
| 2.03 | 1.51 | 1.41 |
| 2.94 | 2.89 | 2.57 |
| 5.05 | 6.68 | 6.18 |

The equivalent sizes of the annulus through which the drilling fluid was flowing for the various drilling fluid flow rates described above were calculated based on the measured stabilized pressure drops and are set forth in Table VI below.

TABLE VI

Equivalent Size of the Annulus - Drilling Fluid

| Flow Rate (bpm) | Measured Pressure Drop (psi/6 ft) | Equivalent Annulus Size |
|---|---|---|
| 1.07 | 1.41 | 5.7 in. × 5.0 in. |
| 2.03 | 1.81 | 5.77 in. × 5.0 in. |
| 2.94 | 2.02 | 5.823 in. × 5.0 in. |
| 5.05 | 3.12 | 5.83 in. × 5.0 in. |

From Table VI, it can be seen that the stabilized area available for flow increased as the drilling fluid circulation flow rate was increased from 1 to 3 bpm. At 5 bpm there was a negligible increase in the net area available for flow and there was a measurable amount of fluid loss at 5 bpm. The lack of increase in the net area available for flow is attributed to filter cake being deposited at about the same rate as it was eroded at the 5 bpm rate.

The drilling fluid was circulated at the various rates described above for a total of about 3 hours. At the end of that time, the drilling fluid circulation was again terminated and the test apparatus 20 was again maintained in a static state at a drilling fluid pressure of 100 psig for about 18 hours during which time fluid loss was collected and recorded.

Figure 8:
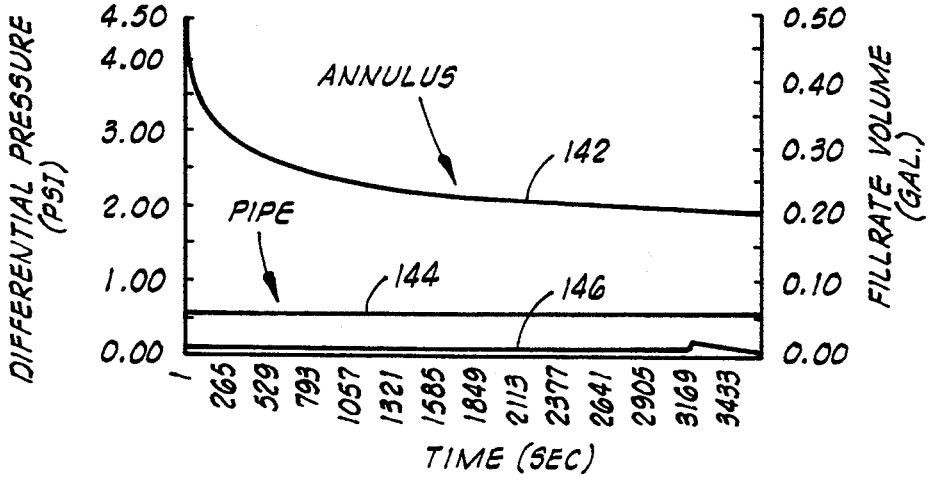
FIG. 8 is a graph similar to FIG. 4 showing additional pipe and annulus differential pressures and fluid losses.

At the end of the shut down period, the drilling fluid circulation was again started at a flow rate of 1 bpm. The measured pressure drops in the annulus (curve 142), inside the pipe (curve 144) and the volume of fluid loss as a function of time (curve 146) are shown in the graph of FIG. 8. A comparison of FIG. 8 with FIG. 4 shows that the pressure drop and fluid loss behavior was essentially the same as previously experienced at a flow rate of 1 barrel per minute.

The flow rate of the circulating drilling fluid was increased to 2 bpm, and after the pressure drop stabilized the flow rate was increased to 3 barrels per minute, and after the pressure drop stabilized at 3 barrels per minute, the flow rate was increased to 5 barrels per minute. The pressure drop and fluid loss behaviors at such rates were essentially the same as the behaviors previously experienced and described above. The measured stabilized pressure drops inside the pipe at the various flow rates are given in Table VII as are the calculated pressure drops.

TABLE VII

Pressure Drops in the Pipe - Drilling Fluid

| Flow Rate (bpm) | Measured Pressure Drop (psi/6 ft) | Calculated Pressure Drop (psi/6 ft) |
|---|---|---|
| 1.07 | 0.49 | 0.43 |
| 2.08 | 1.56 | 1.47 |
| 3.08 | 2.72 | 2.77 |
| 5.07 | 6.70 | 6.22 |

The equivalent sizes of the annulus through which the drilling fluid was flowing at the different flow rates was also calculated from the measured stabilized pressure drops in the annulus. This information is set forth in Table VIII below.

TABLE VIII

Equivalent Size of the Annulus - Drilling Fluid

| Flow Rate (bpm) | Measured Pressure Drop (psi/6 ft) | Equivalent Annulus Size |
|---|---|---|
| 1.07 | 1.85 | 5.63 in. × 5.0 in. |
| 2.08 | 2.39 | 5.695 in. × 5.0 in. |
| 3.08 | 2.67 | 5.754 in. × 5.0 in. |
| 5.07 | 4.21 | 5.75 in. × 5.0 in. |

A comparison of the data given in Table VIII with that given in Table VI shows a decrease in the equivalent size of the annulus which is attributable to the effect of aging.

From Table VI, the pressure drop below which no appreciable erosion takes place, $\Delta p_{bne}$, was 2.02 psi at a flow rate of 2.94 bpm. The equivalent annulus diameter was 0.823 inches. The corresponding minimum shear stress required to erode deposits formed by the drilling fluid is determined as follows:

$$\tau_w = \frac{D_e \Delta p_{bne}}{4L}$$

$$\tau_w = \frac{(0.823)\,(2.02 \times 144 \times 100)}{(4)\,(6)} = 83.12 \text{ lb/100 ft}^2$$

The erodability of the drilling fluid is determined as follows. Based on the estimated smallest particle size of solids in the drilling fluid being 1 μm (Table III), it is estimated that the separation distance of such particles in drilling fluid deposits formed therefrom is 2 nm. The erodability of the drilling fluid then is:

$$E_{df} = \frac{1.991 \times 10^{24}\, Aa}{(4a^2)\,(12h^2)\,(\tau_w)}$$

$$= \frac{(1.991 \times 10^{24})\,(3 \times 10^{-20})\,(0.5)}{(4 \times 0.5^2)\,(12 \times 2^2)\,\tau_w}$$

$$E_{df} = \frac{622}{\tau_w} = \frac{622}{83.12} = 7.5$$

EXAMPLE 2

A 15 ppg aqueous bentonite drilling fluid weighted with barite particles has an erodability of 10 and is used to drill a 7.5" diameter well bore. A 5.0" O.D. casing as placed in the well bore having a length of 1500 feet.

The fracture gradient is 18.2 pounds per gallon, and depending on the equipment available, the upper limit on the flow rate could be 4, 8 or 12.5 bpm. If a spacer is utilized, its plastic viscosity should not be greater than 50 centipoises and its yield point should not be greater than 30 lbf/100 ft$^2$.

The design of a drilling fluid displacement procedure in accordance with the present invention is as follows. Based on the radius of the smallest solid particle size in the drilling fluid being 0.5 micrometer (a=0.5) and the distance between particles being 0.2 micrometer (h=2), the erodability relationship is:

$$E_{df} = \frac{1.991 \times 10^{24}\, Aa}{(4a^2)\,(12h^2)\,(\tau_w)}$$

$$= \frac{(1.991 \times 10^{24})\,(3 \times 10^{-20})\,(.5)}{(4 \times 0.5^2)\,(12 \times 2^2)\,(\tau_w)}$$

$$E_{df} = \frac{622}{\tau_w}$$

Solving for $\tau_w$ based on $E_{df}$ being 10:

$$\tau_w = \frac{622}{10} = 62.2 \text{ lbf/100 ft}^2$$

The pressure drop below which no appreciable erosion takes place is calculated as follows:

$$\Delta p_{bne} = \frac{4L\tau_w}{De} = \frac{(4)\,(1500 \times 12)\,(62.2/100 \times 144)}{2.5} \cong 120 \text{ psi}$$

This pressure drop, i.e., about 120 psi, is needed in the annulus to erode the drilling fluid deposits formed in the well bore.

A water spacer will result in a pressure drop of only 16 psi at a rate as high as 13 bpm, and therefore water can not be utilized.

A 15.0 ppg spacer with a plastic viscosity of 30 centipoises and a yield point of 20 lbf/100 ft$^2$ will have a pressure drop of 120 psi in the annulus when pumped at 12.5 barrels per minute. The equivalent circulating density will be 18.07 ppg which is under the fracture gradient of 18.2 ppg. Thus, this spacer can be used ahead of a cement slurry at a flow rate of 12.5 barrels per minute to remove the drilling fluid deposits.

A 15.0 ppg spacer with a plastic viscosity of 50 centipoises and a yield point of 30 lbf/100 ft$^2$ will also have a pressure drop of 120 psi in the annulus when pumped at a rate of 8 barrels per minute. The equivalent circulating density will be 17.3 ppg. Thus, this spacer could also be used.

At a flow rate of 4 barrels per minute, a spacer can not be designed which will have a pressure drop of 120 psi in the annulus. In the event the pumping rate is limited to 4 barrels per minute, other options such as the use of pipe movement in combination with spacer circulation, mechanical scratchers and the like should be investigated.

EXAMPLE 3

Figure 13:
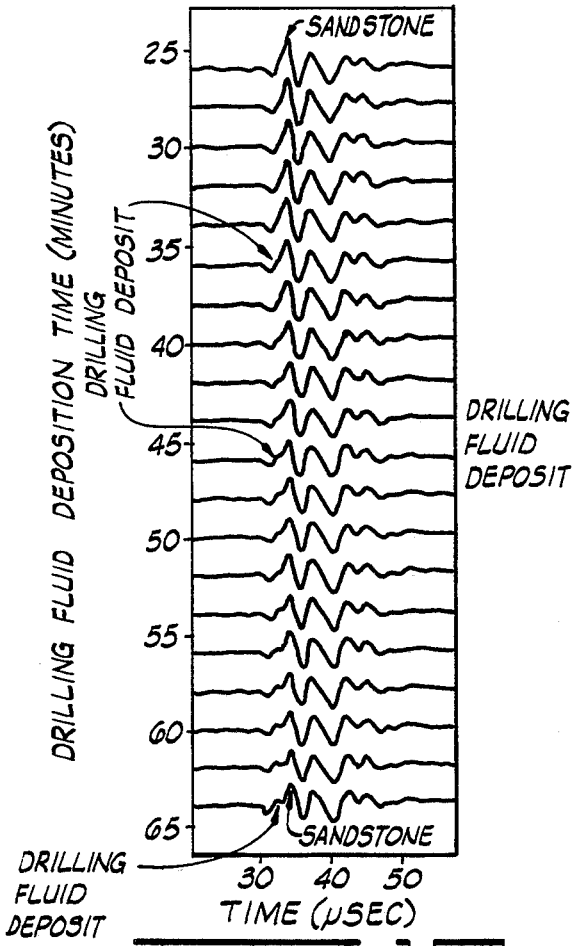
FIG. 13 is a graph showing the wave forms obtained an acoustic thickness measurement system for an aqueous drilling fluid having a density of 12 pounds per gallon.
Figure 14:
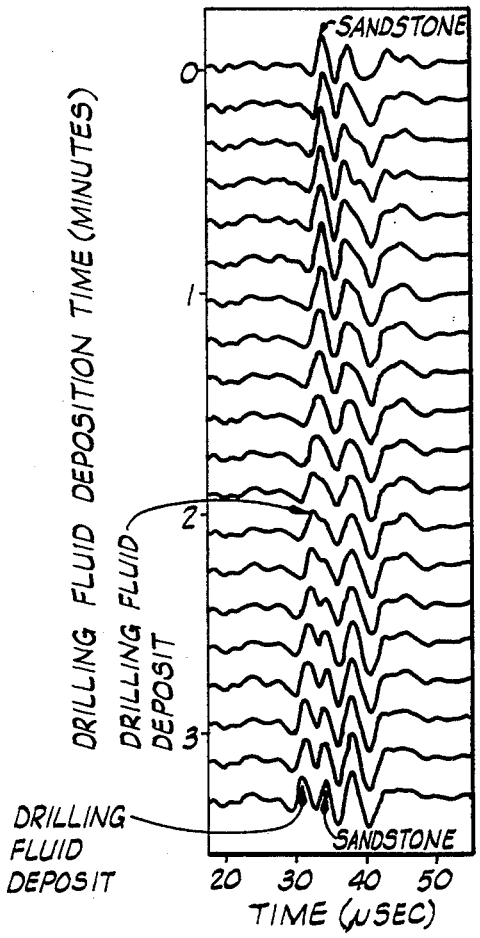
FIG. 14 is a graph similar to FIG. 5 illustrating the wave forms obtained for an aqueous drilling fluid having density of 16 pounds per gallon.
Figure 12:
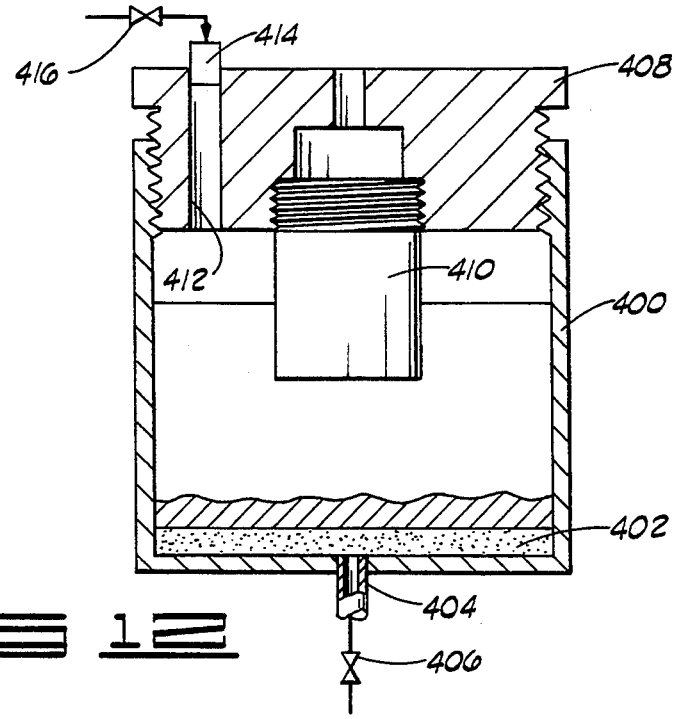
FIG. 12 is a side cross-sectional view of a test chamber for forming drilling fluid deposits and acoustically measuring the thickness of the deposits.

Tests were conducted to determine if an acoustic device could be utilized to measure drilling fluid deposit thicknesses. A chamber of the type illustrated in FIG. 12 was used to form drilling fluid deposits on a porous surface and measure the thickness of the deposits by an ultrasonic transducer. The chamber 400 included a synthetic permeable sandstone medium at the bottom thereof and a liquid filtrate removal conduit 404 was sealingly connected to an opening in the bottom of the chamber 400. A shut-off valve 406 was disposed in the conduit 404. The chamber included a removable top 408 which had an ultrasonic transducer 410 threadedly connected thereto. The transducer 410 was operably connected to a signal processing computer which was used to produce the acoustic wave form graphs of FIGS. 13 and 14 and calculate drilling fluid deposit thickness. The chamber top 408 also included an opening 412 to which a conduit 414 was connected having a shut-off valve 416 disposed therein. The other end of the conduit 414 was connected to a source of pressurized gas. Two aqueous drilling fluids comprised of water, bentonite and weighting material having densities of 12 pounds per gallon and 16 pounds per gallon were tested. Each drilling fluid was placed in the chamber 400, the chamber was sealed, and pressurized gas was bled into the chamber whereby a pressure of 100 psi was exerted on the drilling fluid within the chamber. Liquid filtrate passing through the permeable medium 402 was withdrawn from the chamber 400 by way of the conduit 404 and valve 406 so that a drilling fluid deposit which formed on top of the porous medium. The thickness of the drilling fluid deposits were measured utilizing the acoustic measurement apparatus and such measurements were verified at the end of each test by opening the chamber and measuring the thickness with a ruler. The acoustic measurement apparatus was accurate within 0.01 inch. FIG. 13 illustrates the recorded wave forms when 12 pound per gallon drilling fluid was tested and FIG. 14 illustrates the recorded wave forms for 16 pound per gallon drilling fluid.

In FIG. 13, the first large positive peak shows the echo from the permeable sandstone. As the drilling fluid deposit formed in the test chamber and increased in thickness over time, a bump in the wave form preceding the sandstone peak indicated the deposit, and as the deposit increased in thickness the bump became a peak. The thickness of the deposit was computed based on the travel time of the acoustic signal to and from the deposit times the signal velocity divided by 2. FIG. 14 illustrates the wave forms produced by the higher density 16 pound per gallon drilling fluid. The shape of the wave form is slightly different from that of the lighter drilling fluid due to greater attenuation of the acoustic signal. The last waves shown in FIGS. 13 and 14 when the drilling fluid deposits were their thickest show two distinct echoes, one from the surface of the drilling fluid deposit and the other from the sandstone.

Thus, the present invention is well adapted to carry out the objectives and attain the ends and advantages mentioned as well as those which are inherent therein. While numerous changes may be made by those skilled in the art, such changes are encompassed within the spirit of this invention as defined by the appended claims.

What is claimed is:

1. Apparatus for determining the minimum shear stress required for eroding drilling fluid deposits formed on the walls of a well bore containing a drilling fluid and penetrating one or more permeable formations comprising:

a container simulating a well bore;

means for simulating a permeable subterranean formation disposed within said container;

means for circulating a drilling fluid at selected indicated flow rates through said container and across said means simulating a permeable formation therewithin connected to said container;

means for measuring the pressure drop of said drilling fluid through said container connected thereto;

means for measuring the temperature of said drilling fluid circulating through said container connected thereto;

means for withdrawing samples of said drilling fluid whereby its properties can be determined connected to said container;

means for selectively applying pressure to said drilling fluid contained within said container when said drilling fluid is not being circulated connected to said container; and means for measuring the thickness of drilling fluid deposits in said container connected thereto.

2. The apparatus of claim 1 wherein said means for measuring the thickness of drilling fluid deposits is comprised of acoustic thickness measuring means.

3. The apparatus of claim 2 wherein said acoustic thickness measuring means are comprised of an ultrasonic signal transmitting and receiving transducer and a signal processing computer therefor.

4. The apparatus of claim 1 wherein said means for simulating a permeable subterranean formation comprise a permeable member and means for withdrawing liquid filtrate which flows through said permeable member from said container.

5. The apparatus of claim 4 wherein said permeable member is a fine mesh screen.

6. The apparatus of claim 1 wherein said means for circulating a drilling fluid through said container are comprised of a pump, a drilling fluid reservoir and conduit means connecting said pump and reservoir to said container.

7. The apparatus of claim 1 wherein said means for applying pressure to said drilling fluid contained within said container are comprised of a source of pressurized gas and conduit means connecting said source of pressurized gas to said container.

8. A method of measuring the shear stress required at the walls of a well bore to erode drilling fluid deposits formed thereon as a result of the well bore containing a drilling fluid and penetrating one or more permeable formations comprising the steps of:

(a) introducing said drilling fluid into a permeable section of a test apparatus which simulates a permeable wall section of a well bore;

(b) maintaining said drilling fluid in a static state in said permeable section at a pressure and for a time period such that drilling fluid deposits are formed therein;

(c) circulating said drilling fluid through said permeable section at progressively increasing flow rates and maintaining each of said flow rates for a time period whereby the pressure drop of said drilling fluid through said permeable section stabilizes while measuring said flow rate, said pressure drop, the viscosity, the temperature and the density of said drilling fluid;

(d) determining the stabilized pressure drop measured in step (c) below which no appreciable erosion of said deposits takes place by acoustically measuring and comparing the thicknesses of said drilling fluid deposits during the circulation of drilling fluid at each of said flow rates; and (e) determining the minimum shear stress required to erode said drilling fluid deposits corresponding to the pressure drop below which no appreciable erosion takes place determined in step (d).

9. The method of claim 8 which further comprises the step of determining the erodability of the drilling fluid deposits formed by said drilling fluid based on the minimum shear stress determined in accordance with step (e).

10. The method of claim 9 wherein the erodability of the drilling fluid deposits formed by said drilling fluid is determined based on the relationship:

$$E_{df} = \frac{1.991 \times 10^{24}\, Aa}{(4a^2)\,(12h^2)\,\tau_w}$$

wherein:

$E_{df}$ is the erodability of the drilling fluid deposits;

$\tau_w$ is the minimum shear stress at the wall required to erode the drilling fluid deposits;

A is $3\times10^{-20}$ joules;

a is the average radius of particles in the drilling fluid deposits; and h is the separation distance between particle surfaces;

where the above variables are in consistent units.

11. The method of claim 8 which further comprises the step of calculating and comparing the well bore size equivalents to said stabilized pressure drops to determine the stabilized pressure drop below which no appreciable erosion of said deposits takes place and comparing the result to the determination made in accordance with step (d).

12. The method of claim 11 wherein said well bore size equivalents to said stabilized pressure drops are determined based on the relationship:

$$D_e = \frac{2fLV^2\rho}{g_c\Delta p}$$

wherein:

$D_e$ is the equivalent diameter through which the drilling fluid is flowing;

f is the friction factor of the drilling fluid based on the drilling fluid viscosity and temperature;

L is the length of the flowing area;

V is the velocity of the drilling fluid;

$\rho$ is the drilling fluid density;

$g_c$ is the gravitational constant; and $\Delta p$ is the stabilized pressure drop across the length of the flowing area (L);

where the above variables are in consistent units.

13. The method of claim 8 wherein introducing said drilling fluid into said test apparatus in accordance with step (a) comprises circulating said drilling fluid through said permeable section at a selected flow rate and for a time period whereby the pressure drop of said drilling fluid through said permeable section stabilizes prior to maintaining said drilling fluid in a static state in said permeable section in accordance with step (b).

14. The method of claim 8 wherein said flow rates at which said drilling fluid is circulated in steps (a) and (c) are in the range of from about 0.5 bpm to about 5 bpm.

15. The method of claim 8 wherein said drilling fluid is circulated through said permeable section in accordance with step (c) at three or more progressive flow rates.

16. The method of claim 8 wherein said minimum shear stress required to erode said drilling fluid deposits which occurs at the pressure drop below which no appreciable erosion takes place is determined based on the relationship:

$$\tau_w = \frac{D_e\Delta p_{bne}}{4L}$$

wherein:

$\tau_w$ is the minimum shear stress at the wall required to erode said drilling fluid deposits;

$D_e$ is the equivalent diameter through which the drilling fluid is flowing;

$\Delta p_{bne}$ is the pressure drop across the length of the flowing area (L) below which no appreciable erosion takes place; and L is the length of the flowing area;

where the above variables are in consistent units.

17. A method of measuring the erodability of drilling fluid deposits formed on the walls of a well bore containing a drilling fluid and penetrating one or more permeable formations comprising the steps of:

(a) circulating said drilling fluid through a permeable section a test apparatus which simulates a permeable wall section of a well bore at a selected flow rate and for a time period whereby the pressure drop of said drilling fluid through said permeable section stabilizes;

(b) terminating the circulation of said drilling fluid and maintaining said drilling fluid in a static state in said permeable section at a pressure and for a time period such that drilling fluid deposits comprised of filter cake and gelled drilling fluid are formed therein;

(c) circulating said drilling fluid through said permeable section at three or more progressively increasing flow rates and maintaining each of said flow rates for a time period whereby the pressure drop of said drilling fluid through said permeable section stabilizes while measuring said flow rate, said pressure drop, the viscosity, the temperature and the density of said drilling fluid;

(d) determining the stabilized pressure drop measured in step (c) below which no appreciable erosion of said deposits takes place by acoustically measuring the thicknesses of said drilling fluid deposits at each of said flow rates when the pressure drop stabilizes, calculating the well bore size equivalents to said stabilized pressure drops measured in step (c) based on the relationship:

$$D_e = \frac{2fLV^2\rho}{g_c\Delta p}$$

wherein:

$D_e$ is the equivalent diameter through which the drilling fluid is flowing, f is the friction factor of the drilling fluid based on the drilling fluid viscosity and temperature, L is the length of the flowing area, V is the velocity of the drilling fluid, $\beta$ is the drilling fluid density, $g_c$ is the gravitational constant, $\Delta p$ is the stabilized pressure drop across the length of the flowing area (L), where the above variables are in consistent units, and comparing said acoustically measured drilling fluid deposit thicknesses and said well bore size equivalents to determine the pressure drop below which no appreciable erosion takes place;

(e) determining the minimum shear stress required to erode said drilling fluid deposits corresponding to the pressure drop below which no appreciable erosion takes place determined in step (d) based on the relationship:

$$\tau_w = \frac{D_e \Delta p_{bne}}{4L}$$

wherein:

$\tau_w$ is the minimum shear stress at the wall required to erode said drilling fluid deposits, $D_e$ is the equivalent diameter through which the drilling fluid is flowing, $\Delta p_{bne}$ is the pressure drop across the length of the flowing area (L) below which no appreciable erosion takes place, and L is the length of the flowing area, where the above variables are in consistent units, and (f) calculating the erodability of the drilling fluid deposits formed by said drilling fluid based on the relationship:

$$E_{df} = \frac{1.991 \times 10^{24} Aa}{(4a^2)(12h^2)\tau_w}$$

wherein:

$E_{df}$ is the erodability of the drilling fluid deposits, $\tau_w$ is the minimum shear stress at the wall required to erode said drilling fluid deposits, A is $3 \times 10^{-20}$ joules, a is the average radius of particles in the drilling fluid deposits, and h is the separation distance between particle surfaces, where the above variables are in consistent units.

18. The method of claim 17 wherein said drilling fluid is maintained in said permeable section in a static state in accordance with step (b) for a time period in the range of from about 4 hours to about 48 hours.

19. The method of claim 18 wherein said pressure at which said drilling fluid is maintained in said permeable section in a static state in accordance with step (b) is in the range of from about 100 psig to about 500 psig.

20. The method of claim 19 wherein said selected flow rate at which said drilling fluid is circulated in step (a) is in the range of from about 0.5 bpm to about 5 bpm.

21. The method of claim 20 wherein said three or more progressive flow rates are within the range of from about 0.5 bpm to about 5 bpm.

22. The method of claim 21 wherein said thicknesses of said drilling fluid deposits are measured ultrasonically in accordance with step (d).

* * * * *